US006105337A

United States Patent [19]

Ahn

[11] Patent Number: 6,105,337

[45] Date of Patent: Aug. 22, 2000

[54] SYSTEM FOR MAKING WATERPROOF BAGS BY LINING BAG SHELL WITH TUBULAR FILM

[76] Inventor: Soon-Keun Ahn, Park Town Apt.134-903, #55 Sune-dong, Bundang-ku, Seongnam-shi, Kyungki-do, Rep. of Korea

[21] Appl. No.: 09/190,189

[22] Filed: Nov. 12, 1998

[30] Foreign Application Priority Data

Oct. 14, 1998 [KR] Rep. of Korea ..... 98-42935

[51] Int. Cl.[7] ..... B65B 63/04

[52] U.S. Cl. ..... 53/116; 53/117

[58] Field of Search ..... 53/461, 450, 469, 53/116, 117, 459, 384.1, 570, 410, 412, 416

[56] References Cited

U.S. PATENT DOCUMENTS

| | | | |
|---|---|---|---|
| 3,112,588 | 12/1963 | Barraclough | 53/570 |
| 4,011,708 | 3/1977 | Brown, Jr. | 53/384.1 |
| 4,054,016 | 10/1977 | Van Keulen | 53/570 |
| 4,169,345 | 10/1979 | Duwenga | 53/384.1 |
| 4,598,529 | 7/1986 | Pongrass et al. | 53/570 |
| 4,756,144 | 7/1988 | Jostler | 53/570 |
| 5,327,704 | 7/1994 | Hoekzema et al. | 53/570 |
| 5,806,276 | 9/1998 | Lerner et al. | 53/570 |

FOREIGN PATENT DOCUMENTS 92-8530 11/1992 Rep. of Korea .

*Primary Examiner*—Eugene Kim

[57] ABSTRACT

A system which stacks and folds waterproof tube film in a zigzag configuration in a film receiving box and then inserts the tube film in the film receiving box into an interior of a cylindrical bag. The system also includes a film unwinding means, which is provided with guide rollers for guiding tube film pulled from bobbin and tension controlling rollers. The film is preferably sealed to the interior of the cylindrical bag to form a waterproof bag.

2 Claims, 8 Drawing Sheets

SYSTEM FOR MAKING WATERPROOF BAGS BY LINING BAG SHELL WITH TUBULAR FILM

BACKGROUND OF INVENTION

1. Technical Field

The present invention relates to a system which automatically stacks and folds waterproof tube film in a zigzag configuration in a film receiving box and then efficiently inserts the tube film received into an interior of cylindrical bag.

2. Background Art

In general, in order to package fertilizer or grain, etc. requiring a moisture-proof cylindrical bag made by weaving synthetic resin yarn lengthwise and breadth-wise, a waterproof bag is formed by inserting a cylindrically extruded tube film into the interior of the cylindrical bag, and then thermally adhering the inserted tube film to the cylindrical bag by means of a radio frequency thermal-adhering process.

Heretofore, a system for weaving a cylindrical bag and simultaneously inserting a tube film into its interior has been disclosed in Korean U.M. Publication 92-8530 by the same applicant of this application.

The 92-8530 publication relates to a system in which a rotating shaft of circular weaving machine for weaving the cylindrical bag from synthetic resin stretch yarns is wound on a hollow shaft, and then at a time of weaving the cylindrical bag at the circular weaving machine, the tube film wound in a roller is continuously supplied through the hollow shaft, so that the tube film is inserted into the interior of the cylindrical bag which is woven. Since this prior art inserting system can readily insert the tube film into its interior simultaneously with weaving the cylindrical bag, it is capable of improving manufacturing efficiency of waterproof bags adhered with tube film to the interior, surface thereof. Thus, a considerable improvement may be achieved. However, there are problems with that system as follows.

Ordinarily, cylindrical fabrics woven by a circular weaving machine are manufactured in a length of usually 1500–2000 m, and the width (or diameter) of a cylindrical bag is determined by the shuttle portion provided in the circular weaving machine. In the case of manufacturing different size cylindrical bags while providing the shuttle portion matched with the width of the cylindrical bag, the shuttle portion has to be disassembled and a new shuttle portion provided. There is a problem in that an operating process for changing the shuttle portion is very difficult, and much time is required and since the manufacturing speed of the tube film per unit time is five (5) times faster than the manufacturing speed of cylindrical fabrics. Because of this difference in manufacturing speeds of both processes, the tube film should be previously produced and stored by winding on a roller, and then laminated by supplying during weaving of the cylindrical fabrics. Exposure to moisture for long periods of the tube film, has been a problem in that large quantity orders are difficult to complete within a short period of time.

SUMMARY OF THE INVENTION

The present invention solves such problems of the conventional technique described above, and an object of the present invention is to provide a storage processing system of tube film for waterproof bag manufacturing which uses materials in which cylindrical bags are previously produced by sizes regardless of orders, and stored by winding to a winding roller, and when a size of bag to be produced is determined, the tube film to be matched to that size is continuously extruded. At the same time, the tube film is arranged in optimum conditions capable of insertion into the cylindrical bag, so that various sizes of waterproof bags can be speedily manufactured.

In order to accomplish the above object, the present invention is characterized by comprising:

- a film unwinding means which is provided with guide rollers for guiding a tube film pulled from a bobbin and tension controlling rollers, which are elastically supported by springs and controlling a pulling tension;
- a base in which first and second lifting chambers are formed at a bottom portion, and conveying racks are provided at a top portion;
- a basic carriage that is provided with drive means for the conveying rack of the base, which reciprocates the base in response to a bi-directional drive motor.
- upper and lower pulling rollers provided in pairs, respectively, at top and bottom portions of the basic carriage, and for pulling the tube film from said film unwinding means by actuation of a uni-directional drive motor coupled to the pulling rollers;
- first and second lifters which are provided to each of said first and second lifting chambers, selectively moving up and down by associated lifting cylinders;
- a film receiving box which is either selectively placed on said first and second lifters, and which receives the tube film pulled from said reciprocally operating basic carriage in a zigzag stacked and folded configuration located on the first lifter, and which moves to the second lifter according to operation of said first and second lifters when the stacking and folding is finished;
- a horizontally conveying cylinder which horizontally pushes the film receiving box on said first lifter at a time when said first and second lifters are down, in order to move the film receiving box stacked with said tube film in a folded configuration onto said second lifter position, and thereby loading by moving onto said second lifter;
- a pair of guide rollers which are respectively provided at both sides of the film receiving box so as to support rotating rollers which are protruded and attached to both sides of the film receiving box placed on each of the lifters at positions where said first and second lifters are lifted up; and
- forward and backward driving cylinders for forwardly conveying said guide rollers so as to release the supporting state at a time when the film receiving box is down.

Further scope of the applicability of the present invention will become apparent from the detailed description given hereinafter. However, it should be understood that the detailed description and specific examples, while indicating preferred embodiment of the invention, are given by way of illustration only, since various changes and modification within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 6 and 7 are cross sectional views taken along B—B line of FIG. 3, in which FIG. 6 is a view of operating state for lifting the film receiving box where a stack of film tube is completed, and FIG. 7 is a view of operating state for inserting a tube film into the interior of cylindrical bag.

DETAILED DESCRIPTION OF THE PREFERRED EMBODIMENT

Hereinafter, an embodiment of the present invention will be described in more detail with reference to the accompanying drawings.

Figure 1:
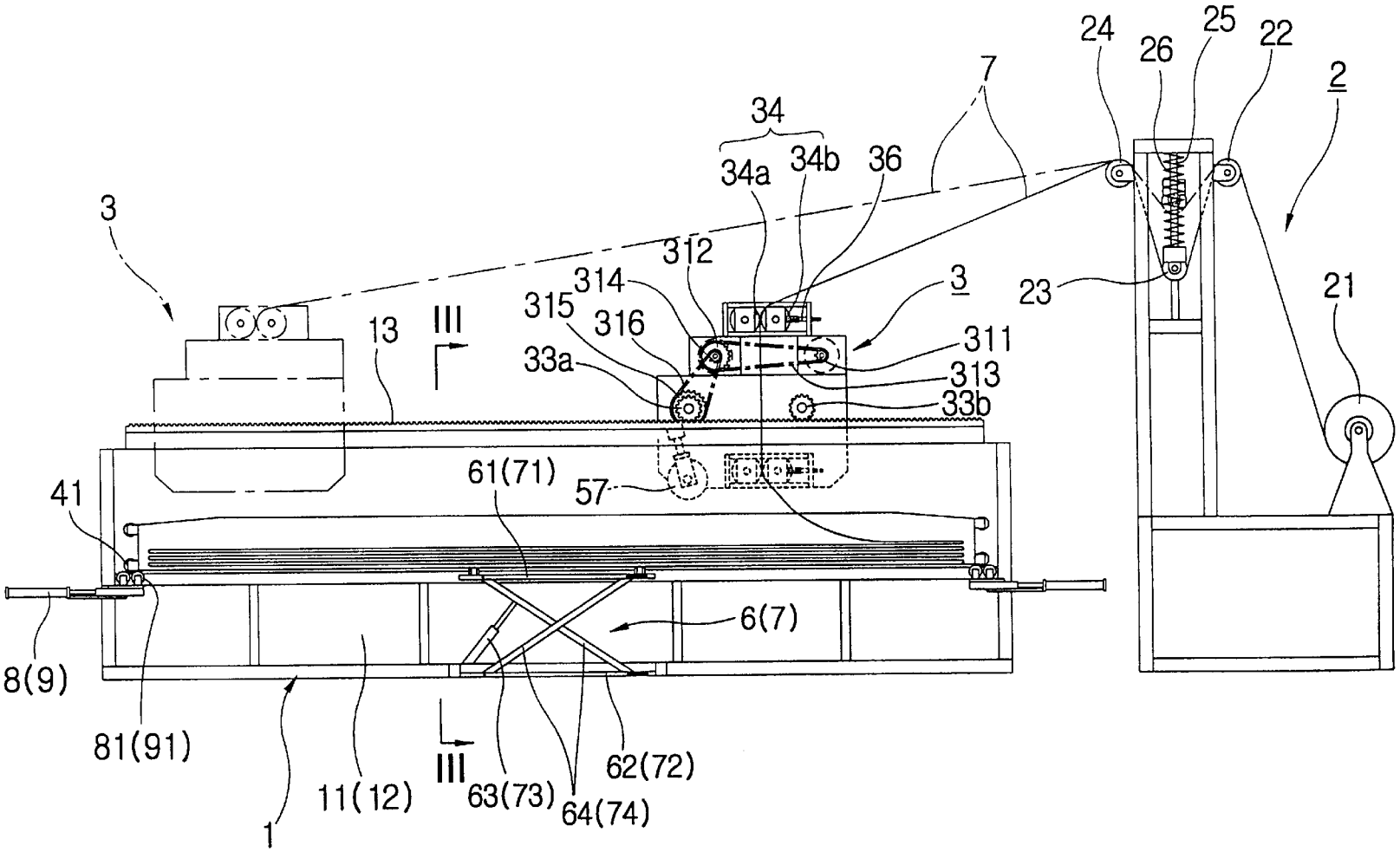
FIG. 1 is a view showing the entire construction of the system depicting the present invention, and a process for receiving the tube film to a film receiving box while a basic carriage reciprocates, right and left.
Figure 2:
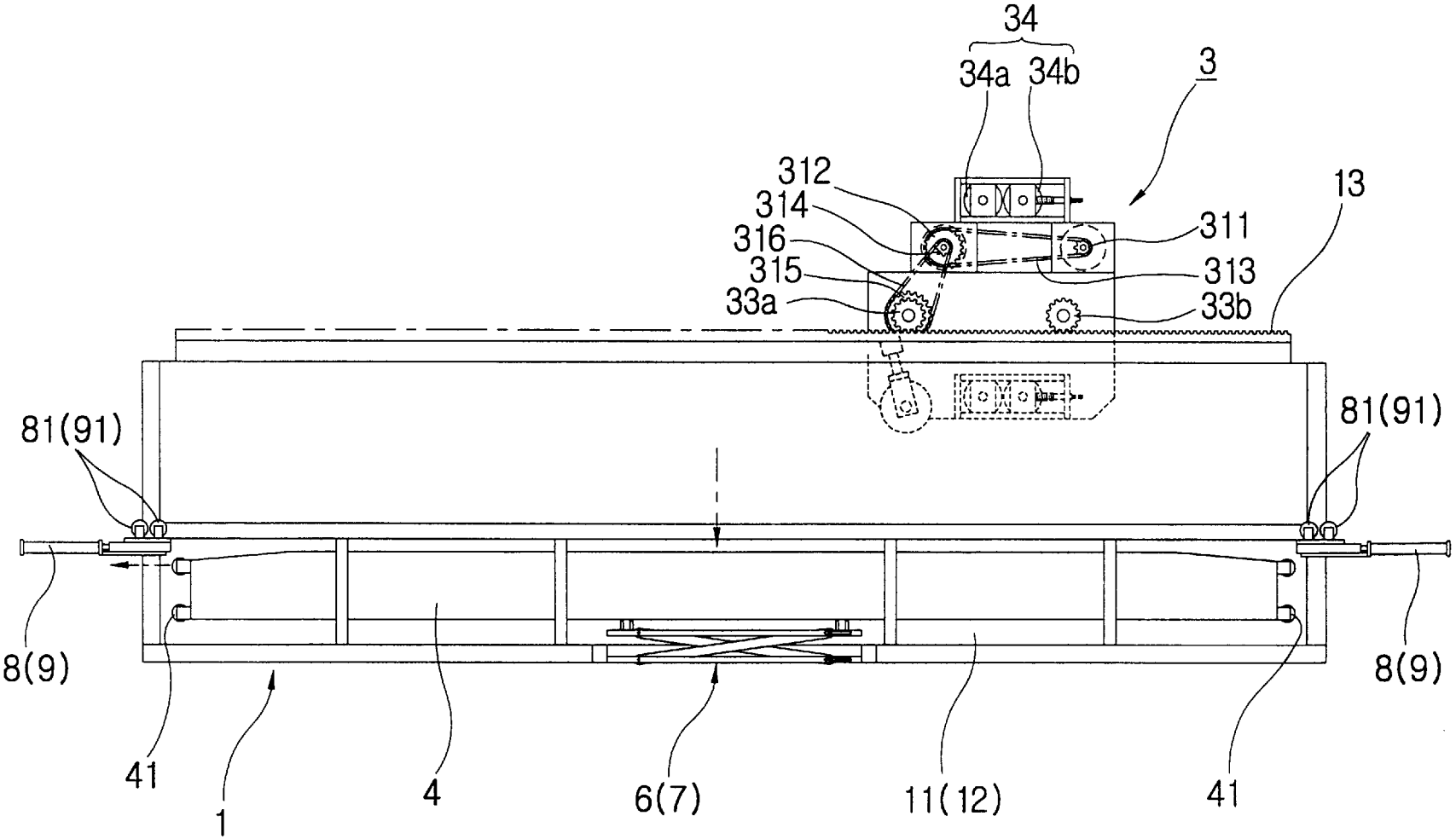
FIG. 2 is a side elevational view depicting the film receiving box of the present invention in a lowered state.
Figure 3:
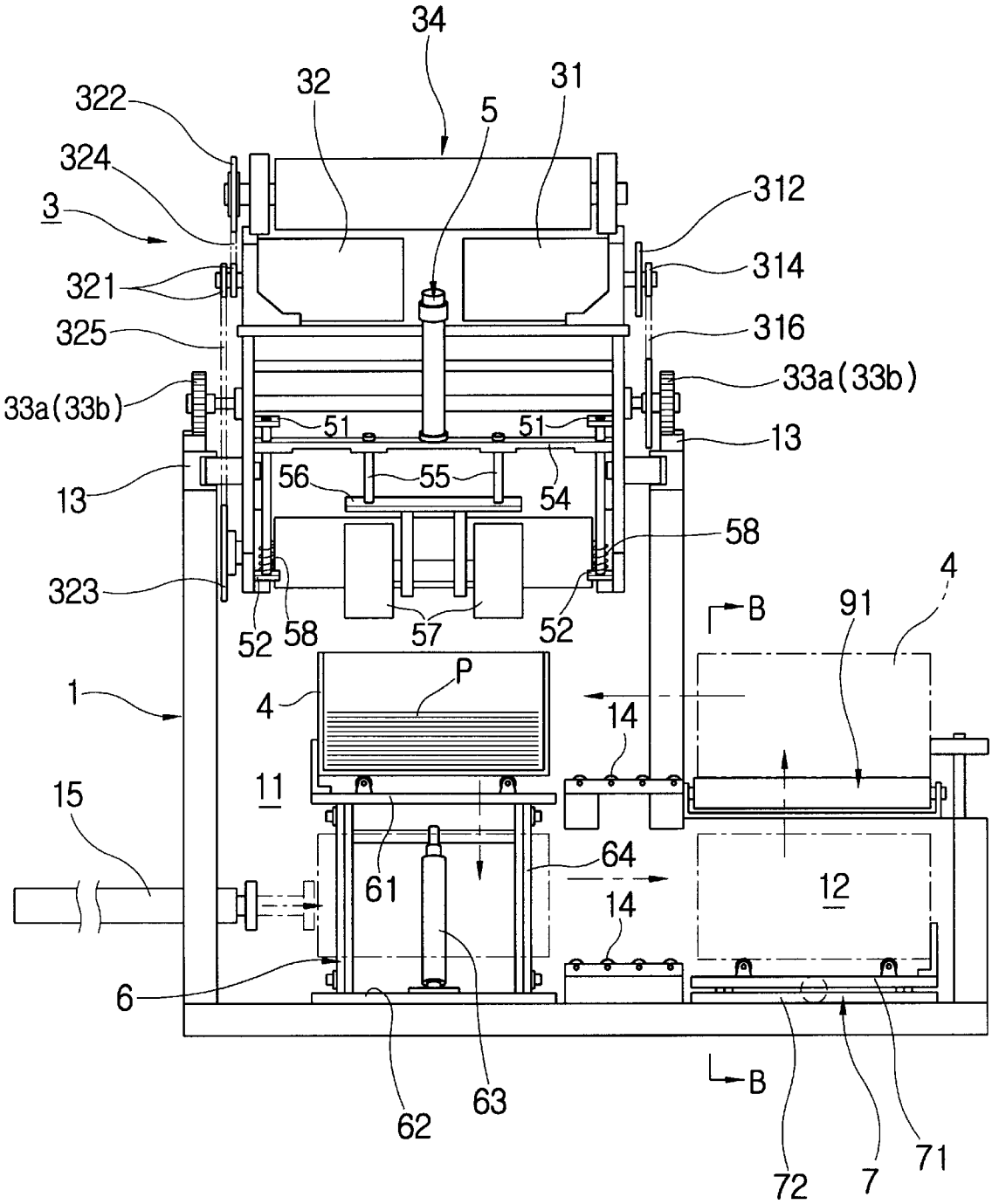
FIG. 3 is a cross sectional view taken along III—III line of FIG. 1 depicting the conveying path of the film receiving box.

FIG. 1 is a view of the entire construction of the system for explaining the present invention, and showing a process for receiving the tube film into the film receiving box while the basic carriage moves right to left.

A reference numeral symbol 1 denotes a base, and a reference numeral symbol 2 depicts film-unwinding means.

The film unwinding means 2 is provided with bobbin 21 which unwinds a tube film (Ap), and the tube film (P) unwound from the bobbin 21 is constructed to pass forward side guide roller 22, tension controlling roller 23 and backward side guide roller 24. And the tension controlling roller 23 of the rollers is so constructed that its both ends are freely provided for lifting up and lowering on vertical rod 25, and is elastically supported by spring 26 so that a pulling tension of the tube film (P) can be controlled.

The base 1 is formed with first and second lifting chambers 11, 12 at lower portions, and conveying racks 13 are provided longitudinally toward right and left as train rails at a top portion of base 1.

A basic carriage 3 reciprocating right to left is provided on the conveying racks 13 of the base 1.

Two motors are provided for the basic carriage 3, and one of which is bi-directional motor 31 for transferring rotational power in a forward direction and reverse direction, and another which is a uni-directional motor 32 for transferring rotational power in one direction only.

Figure 4:
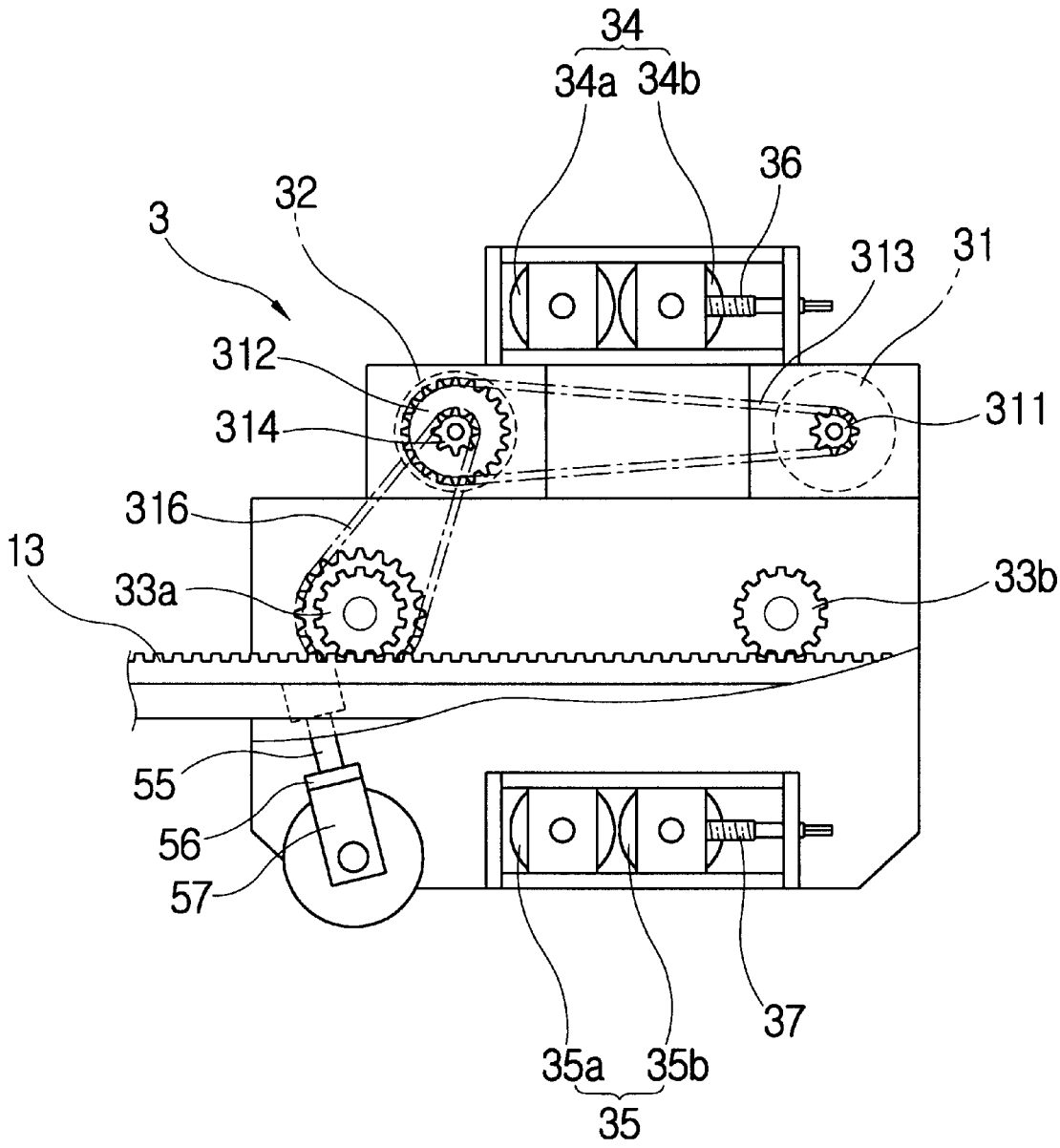
FIGS. 4 and 5 are partly cut-away right side and left side views of a basic carriage which is part of the present invention.
Figure 5:
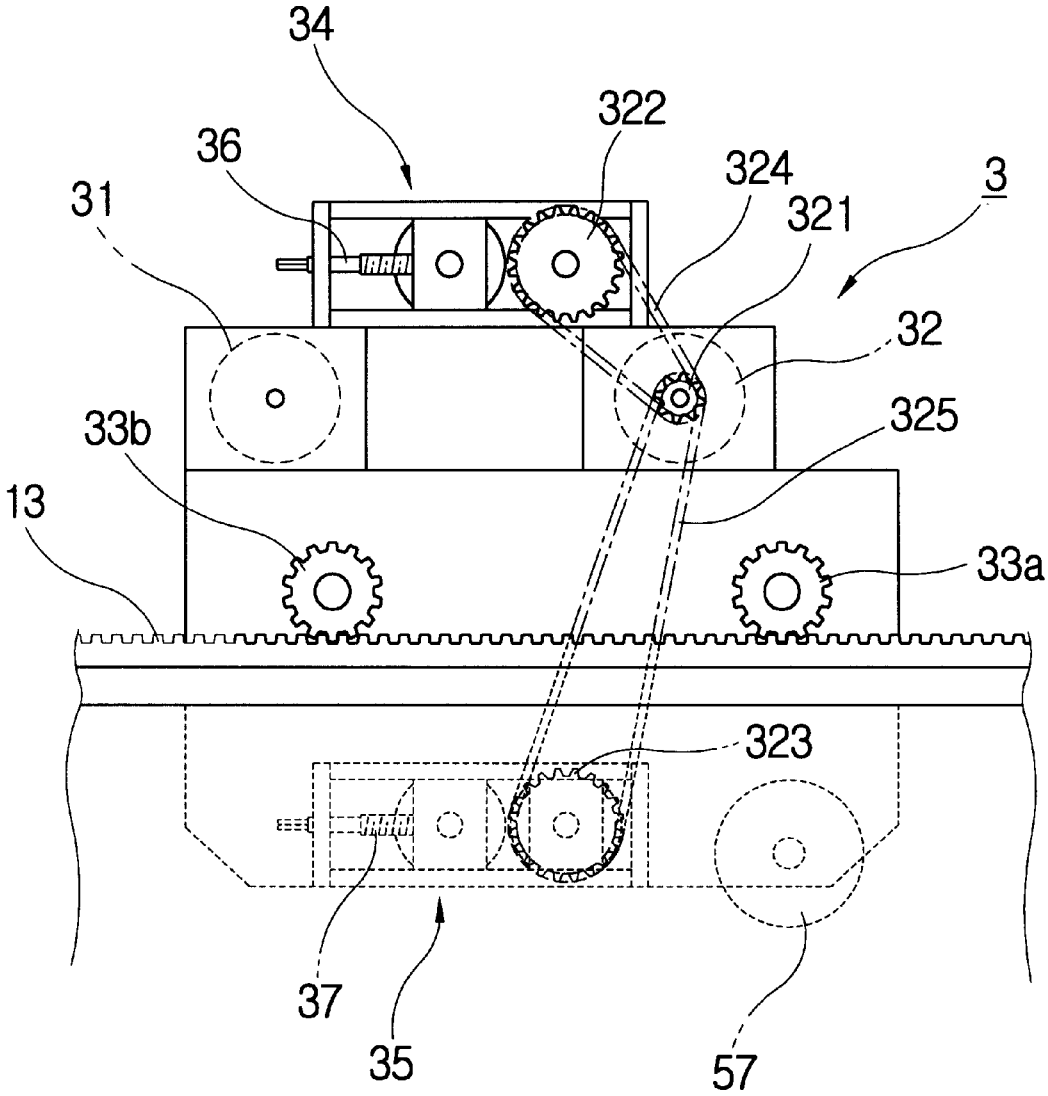
Figure 6:
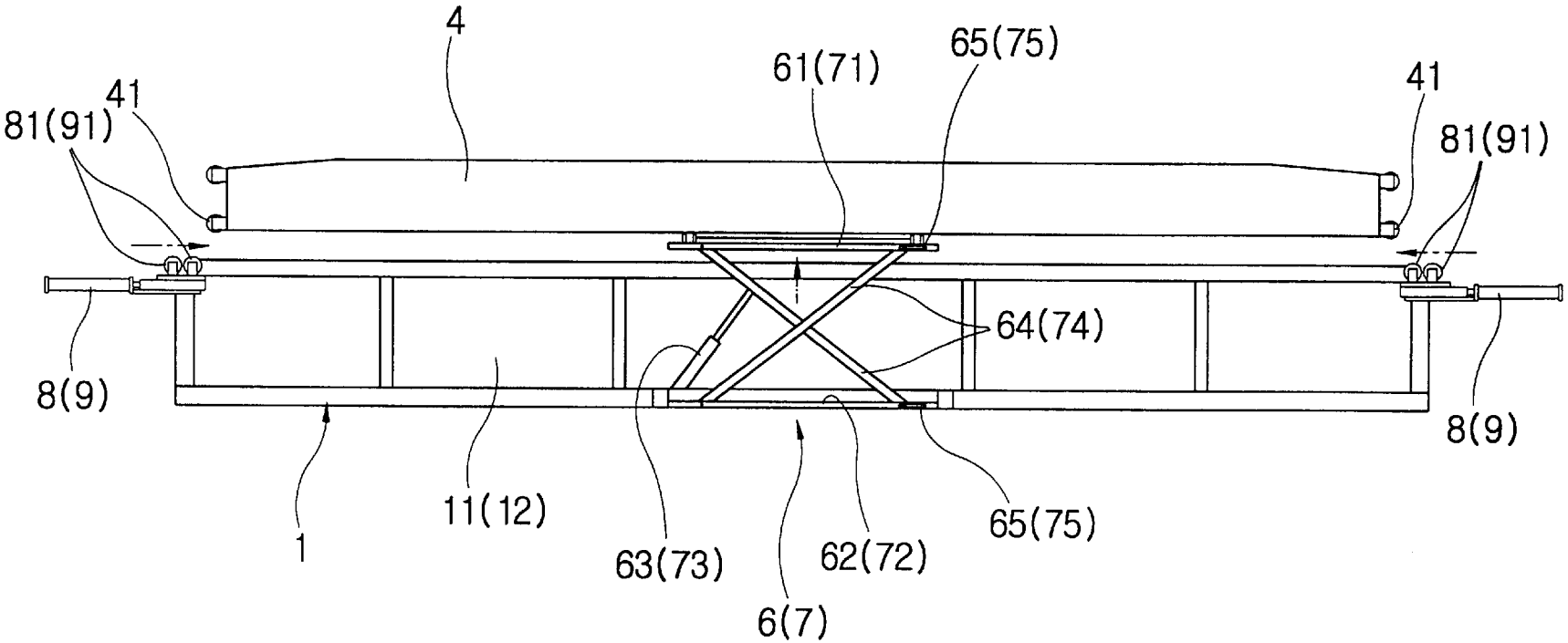
Figure 7:
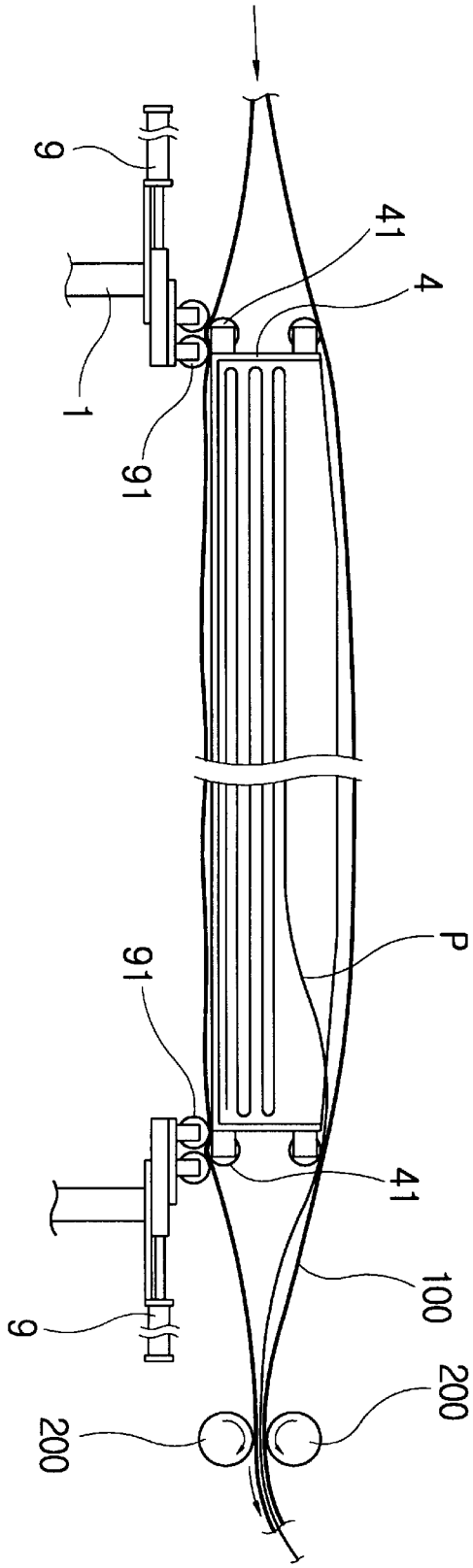

A small driving chain gear 311 is provided at the output side of the bi-directional motor 31, and the small driving chain gear 311 is connected to a large driven chain gear 312 via primary connecting chain 313 as shown in FIG. 4, whereby the rotating output speed of the bi-directional motor 31 is reduced, and small driven chain gear 314 provided on a coaxial line of the large driven chain gear 312 is connected by secondary connecting chain 316 to a large driven chain gear 315 provided downwardly thereof. Accordingly, the large driven chain gear 315 is secondarily reduced and rotated.

A shaft of the large driven chain gear 315 is provided along both sides of the basic carriage, and a driving pinion 33a is provided at both ends thereof, and a driven pinion 33b is provided at both sides of opposite sides of the driving pinion 33b. The driving and driven pinions are meshed with the conveying rack 13 provided at the top portion of the base 1 so as to reciprocate the basic carriage 3.

The unidirectional motor 32 rotatably drives upper and lower pulling rollers 34, 35 provided respectively by one pair at upper and lower portions of the basic carriage 3. That is, driving rollers 34*a*, 35*a*, are rotated in the same direction by connecting two small chain gears 321 coupled to output shaft of the uni-directional motor 32 and the large chain gears 322, 323 coupled to the driving rollers' 34*a*, 35*a* shafts of each of the upper and lower pulling rollers 34, 35 via chains 324, 325. Since the driven rollers 34*b*, 35*b* correspondingly provided on a horizontal level to each of the driving rollers 34*a*, 35*a* are rotated in a reverse direction by the driving roller, when unidirectional motor 32 is driven in a state in which the pulling end of the tube film (P) is pulled from the film unwinding means 2 to between the driving side and driven side rollers of the upper and lower pulling rollers 34, 35, the tube film (P) is pulled by operation of the upper and lower pulling rollers 34, 35, and thus pulled tube film (P) is stacked and folded in a zigzag manner to the film receiving box 4 located downwardly thereof.

So as to make the insertion of the tube film (P) between the driving side and driven side rollers of the upper and lower pulling rollers 34, 35 easy, and to make the pulling operation exact, clearance of the driven side rollers 34*b*, 35*b* can be widened against the driving side rollers via thread tightening and thread releasing operations of the clearance adjusting rods 36, 37, and the meshed state can be adjusted as well.

A cylinder 5 operated by pneumatic pressure is fixedly provided at a slightly inclined state toward lower pulling roller 35 at one side of the basic carriage 3, and guide rods 53 are provided to upper and lower side protrusions 51, 52 fixed to upper and lower sides of both sidewall surfaces of the basic carriage 3 of positions provided with the cylinder 5 at same angle as the angle of the cylinder 5, and both ends of the operating bar 54 attached on a horizontal level at the front end of the piston rod of the cylinder 5 are provided freely lifting and falling operations toward the top and down states along both sides guide rod 53.

And, two circular rollers 57 are rotatably provided to a fixing means 56 horizontally attached to fixing bars 55 downwardly disposed from the operating bar 54. And since springs 58 are provided on the fixing bars 55, absorbing action is made at a time when the operating bar 54 is down by the cylinder 5, the compression circular rollers 57 can elastically and tenderly press the tube film (P) stacked and folded in the film receiving box 4.

Next, the first lifting chamber 11 of the base 1 is formed at the lower right of the basic carriage 3, and the top-right of the second lifting chamber 12 formed beside the first lifting chamber 11 is vacant.

The first and second lifters 6, 7 are provided in each of the first and second lifting chambers 11, 12, and bottom portions 62, 72 of the first and second lifters, 6, 7 are fixed at the bottom of the base 1. The top portions 61, 71 are so arranged that lifting and falling operations are driven by the lifting cylinders 63, 73.

That is, top and bottom portions of the first and second lifters 6, 7 are connected by lifting bars 64, 74 having an "X" shape. One end of the lifting bar is fixed to one side of the top and bottom portions 61, 62, 71, 72, while another end is movably fixed toward right and left at a state connected to elongate holes 65, 75, so that the lifting bars 64, 74 can cause the top portions 61, 71 to be lifted and lowered as the piston rods of the lifting cylinders 63, 73 reciprocate.

Next, the first and second lifting chambers 11, 12 are formed by an elongate transverse space in order to contain the film receiving box 4, and supporting and guiding rollers 81, 91 for movement forwardly and backwardly within the interior of the lifting chambers by the forward and backward drive cylinders 8, 9 respectively provided along both sidewalls of the first and second lifting chambers 11, 12. Positions of the supporting and guiding rollers are made to be able to support the rotating rollers 41, rotatably attached to both ends of the film receiving box 4, when the first and second lifters 6, 7 are lifted up and lowered to position the film receiving box 4.

A number of conveying rollers 14 are provided to a middle portion of both wall surfaces of the first and second lifting chambers 11, 12 (wall surface positions between the supporting and guiding roller 81 and 91 supporting the film receiving box 4), so that the film receiving box 4, lifted up to top portion by the second lifter 7, can be horizontally moved to first lifter 6 of the first lifting chamber 11 whereby the film receiving box 4 can be moved.

On the other hand, an operation for inserting the tube film (P) to the cylindrical bag 100 is progressed at a state that the film receiving box 4 finished with a stacked and folded tube film (P) by the second lifter 7 is lifted to the top portion of the second lifting chamber 12.

That is, at one side (left side on drawing) of the film receiving box 4 lifted by the second lifter 7, in a state when the top side and right/left sides of an opening to be an inserting end of the cylindrical bag 100, are made to surround the film receiving box 4 while the bottom side thereof is made to be passed between the supporting and guiding roller 91 and the rotating roller 41 of one side of the film receiving box 4. Thereby, the bottom portion of the film receiving box 4 is surrounded, is moved to an opposite side, and then the bottom portion of the opening again passes between the rotating roller 41 and the supporting and guiding roller 91 of another side (right side on drawing) while the top side and the right/left sides of the opening are pulled as each is surrounded from outside of the rotating roller 41. At this moment, a pulling end of the tube film (P) stacked and folded in the film receiving box 4 is made to slightly extend from the interior of the opening of the cylindrical bag 100. Thus, in a state where the opening of the cylindrical bag 100 surrounds the film receiving box 4, and the tube film (P) slightly extended, both from the opening are interposed between a pair of bag-pulling rollers. When the bag-pulling rollers 200 are rotatably driven, the tube film (P) can be continuously inserted into the interior of the cylindrical bag 100 being pulled.

Explaining an operation for stacking and folding the tube film (P) into the film receiving box 4. An operation for inserting the tube film (P) into the interior of the cylindrical bag 100 in accordance with the present invention is performed by a constructing principle as described above, it will be as follows.

Firstly, the tube film (P) wound on the bobbin 21 of the film unwinding means 2, is passed through the pulling roller 22 on the front side of the tension control roller 23, and the guide roller 24 on the side, as shown in FIG. 1. Then it is brought to the upper and lower pulling rollers 34, 35 of the basic carriage 3, and at this moment, clearances between the driven rollers 34b, 35b of the upper and lower pulling rollers 34, 35 are widened by releasing the clearance adjusting rods 36, 37. Then a pulling or lead end of the tube film (P) is inserted thereunto. Thereafter, the clearance adjusting rods 36, 37 are screwed and tightened, so that the tube film (P) is suitably pressed between the driving rollers and the driven rollers.

As descried above, when the basic carriage 3 is operated such that the clearance adjustment is finished, so that the upper and lower pulling rollers 34, 35 can pull the tube film (P), the bi-directional motor 31 coupled to the basic carriage 3 rotates the drive pinion 33*a* at a suitably reduced speed, so that the drive pinion 33*a* together with the driven pinion 33b ride along the conveying rack 13. Since the bi-directional motor 31 is made to be rotated in forward or reverse directions by receiving a control signal from a detecting sensor (not shown), when the basic carriage 3 reaches the left side end portion and right side end portion of the conveying rack 13, the basic carriage 3 reciprocates right and left on the basic carriage 3, and simultaneously with this, the uni-directional motor 32 is also driven, whereby it rotates the drive rollers 34*a*, 35*a* of the upper and lower pulling rollers 34, 35 at a suitably reduced speed, and thereby the tube film (P) is pulled from the film unwinding means 2 by operation of the upper and lower pulling rollers 34, 35. Then received the film is received in box 4 supported by the supporting and guiding rollers 81 of the first lifting chamber 11.

When explaining how the tube film (P) is received in the film receiving box 4, in a case when the basic carriage 3 is located at the right side of the base 1 as seen on the drawings (position near location provided with film unwinding means), and moved to the left side, the tube film (P) pulled by the upper and lower pulling rollers 34, 35 is received by spreading from the right side to left side of the film receiving box 4. This is a state wherein the basic carriage 3 is moving, and thus in a state that the basic carriage 3 moves from the right side to left side, the tube film (P) is constantly fed to the film receiving box 4 by operation of the upper and lower pulling rollers 34, 35, while the tension of the tube film (P) pulled from the film unwinding means 2 becomes stronger as a function of the speed of the basic carriage 3. In this case, the tension control roller 24 compresses the spring 26 and moves upward by a tension of the tube film (P), and thereby the basic carriage 3 moves to left side end on the drawings, the tube film (P) is pulled by the upper and lower pulling rollers 34, 35 at constant tension without being cut and fed to the film receiving box 4. In the case when the basic carriage 3 is moved to left side end, and thereafter receives a control signal to move to a reverse direction, i.e., to right side on the drawings, the tube film (P) fed to the film receiving box 4 becomes folded, stacked, and stored toward the right side direction. On the other hand, since the basic carriage 3 moves toward film unwinding means 2, tension of the tube film (P) becomes loosened. At this moment, since the tension control roller 23 which previously ascended by pressing the spring 26, is descended by the returning resilient force of the spring whereby tension of the tube film (P) is made to be restored to a taught state, the tube film (P) is pulled at constant speed by the upper and lower pulling rollers 34, 35 in a state always maintaining tension and stored to the film receiving box 4.

As described above, the basic carriage 3 stores by stacking in a zigzag manner to the film receiving box 4 by reciprocating to right and left. Air becomes present between the tube film (P) thus stacked and folded in zigzag manner, and it needs to press the stacked tube film (P) since the tube film (P) is piled in swollen state by air. The compression circular rollers 57 provided at one side of the basic carriage 3 descend and press the tube film (P), whereby the tube film (P) is made to be stacked and stored in a flat state.

That is, the basic carriage 3 reaches the right side end or left side end whereby changing the moving direction, and the cylinder 5 is operated by an operating sensor whereby the piston rod is pulled out therefrom, and according to this, since the operating bar 54 is descended by receiving a guide of the guide rod 53, the compression circular roller 57 is also descended and presses the tube film (P), whereby the air contained between the stacked tube films (P) is excluded. Since the spring 58 is present at the guide rod 53, an absorbing action is made at a time when the operating rod 54 is descended, and thereby the compression circular rollers 57 can resiliently and tenderly press the tube film (P) whereby the tube film (P) does not receive damage. On the other hand, when the cylinder 5 is made to operate several times, not only at a time when the basic carriage 3 reaches right and left end, but also when the basic carriage 3 is reciprocating, the piled and stored tube film (P) can be flatly stacked.

As described above, when the basic carriage 3 is reciprocated to right and left and reaches a state with the tube film (P) in the film receiving box 4, the first lifter 6 of the first lifting chamber 11 is operated whereby the film receiving box 4 is moved to the bottom.

When the first lifter 6 moves the film receiving box 4 to the bottom, firstly when the lifting and falling cylinder 63 pulls out the piston rod a little more, the rotating rollers 41 of both ends of the film receiving box 4 is moved to top-ward of the both sides supporting and guiding roller 81, and when the frontward and backward driving cylinder 8 is operated pushing the piston rod in, the supporting and guiding roller 81 moves downward of the rotating roller 11. Subsequently, when the lifting and falling cylinder 63 pushes the piston rod whereby top portion 61 of the first lifter 6 is descended, the film receiving box 4 is descended downwardly in the first lifting chamber 11.

When the first lifter 6 completely moves the film receiving box 4 down, the piston rod of the conveying cylinder 14 provided at one end of the base 1 is pulled out whereby the film receiving box 4 is moved to the second lifting chamber 12. At this moment, since the top portion 71 of the first lifter 7 reaches a completely descended state, the film receiving box 4 moved by the conveying cylinder 15 is passed to above the moving roller 16 to the top portion 71 of the second lifter 7.

As described above, when the film receiving box 4 is moved to the top portion 71 of the second lifter 7, the top portion 71 is ascended by operation of the cylinder 73 of the second lifter 7. At this moment, since the forward and backward driving cylinder 9 provided to both sidewall surfaces of the second lifting chamber 12 pushes the piston rod in, whereby the supporting and guiding roller 91 is moved backward, the second lifter 7 ascends the film receiving box 4 to a slightly higher position than the supporting and guiding roller 91, and subsequently when the forward and backward driving cylinder 9 pulls out the piston rod, the supporting and guiding roller 91 to be positioned downwardly of the rotating roller 41 attached to both sides of the film receiving box 4, the second lifter 7 is immediately descended. Accordingly, the film receiving box 4 is descended, and the rotating roller 41 of both ends thereof is supported by the supporting and guiding roller 91, and the second lifter 7 is successively descended, whereby its top portion 71 become ready to move and load the film receiving box 4.

As described above, the interior of the film receiving box 4 supported by the supporting and guiding roller 91 of the second lifting chamber 12 is ready to be inserted into the cylindrical bag 100.

In a state as described above, the opening of the cylindrical bog 100 completely surrounds the film receiving box 4. That is, at one side (left side of the drawings) of the film receiving box 4 lifted by the second lifter 7, the top side and the left/right side of the opening, which becomes an inserting end of the cylindrical bag 100, is made to surround the film receiving box 4 while the bottom side passes between the supporting and guiding roller 91 and the rotating roller 41 of one side of the film receiving box 4. It is moved to an opposite side, and then the bottom portion of the opening again passes between the rotating roller 41 and the supporting and guiding roller 91 of other side (right side on the drawings). On the other hand, top side and right/left side of the opening is pulled as it is surrounded from outside of the rotating roller 41, and at this moment, the lead end of the tube film (P) folded and stacked into the film receiving box 4 becomes slightly exposed form opening of the cylindrical bag 100. Thus, in a state that the opening of the cylindrical bag 100 surrounding the film receiving box 4 and the tube film (P) is slightly exposed, the bag and film become interposed between a pair of bag pulling rollers 200. When the bag pulling rollers 200 are rotatably driven, the cylindrical bag 100 and the tube film (P) are pulled together and the tube film is interposed within interior of the pulled out cylindrical bag 100. Thus, as the bag pulling rollers 200 continuously pull out the cylindrical bag 100, it is successively pulled out such that the tube film (P) is inserted within interior of the cylindrical bag 100 and then conveyed for further processing.

When all of the tube films (P) stored in the film receiving box 4 are completely inserted to the cylindrical bag 100 by an operation as above, supply of the cylindrical bag 100 stops, and thus after the inserting operation of the tube film (P) is finished, an empty film receiving box 4 is moved toward first lifting chamber 11, and in this case, the empty film receiving box 4 may be automatically moved by providing an automatic pushing device. But in an embodiment of this invention, the empty film receiving box 4 is moved to the first lifting chamber 11 by means an operator that pushes the empty film receiving box 4. At this moment, the frontward and backward driving cylinder 8 provided at both sides wall surfaces of the first lifting chamber 11, is operated, whereby the supporting and guiding roller 81 moves forward. Thereby, the film receiving box 4 moved by riding the conveying roller 14 becomes ready to store the tube film (P), since the rotating roller 41 of both ends thereof is put on the supporting and guiding roller 81. In this state, as aforementioned, the basic carriage 3 is operated for stacking and folding the tube film (P) in the film receiving box 4. When the piling and storing operation of the tube film (P) in the film receiving box 4 is finished, after descending it to first lifter 6, moved to second lifter 7, and subsequently in a state that the second lifter 7 is ascended, whereby the rotating roller 41 of both ends of the film receiving box 4 is supported by the supporting and guiding roller 91, in accordance with means wherein the cylindrical bag 100 passes around the external circumference of the film receiving box 4. The operation for inserting the tube film (P) into the cylindrical bag 100 is then repeated.

Figure 8:
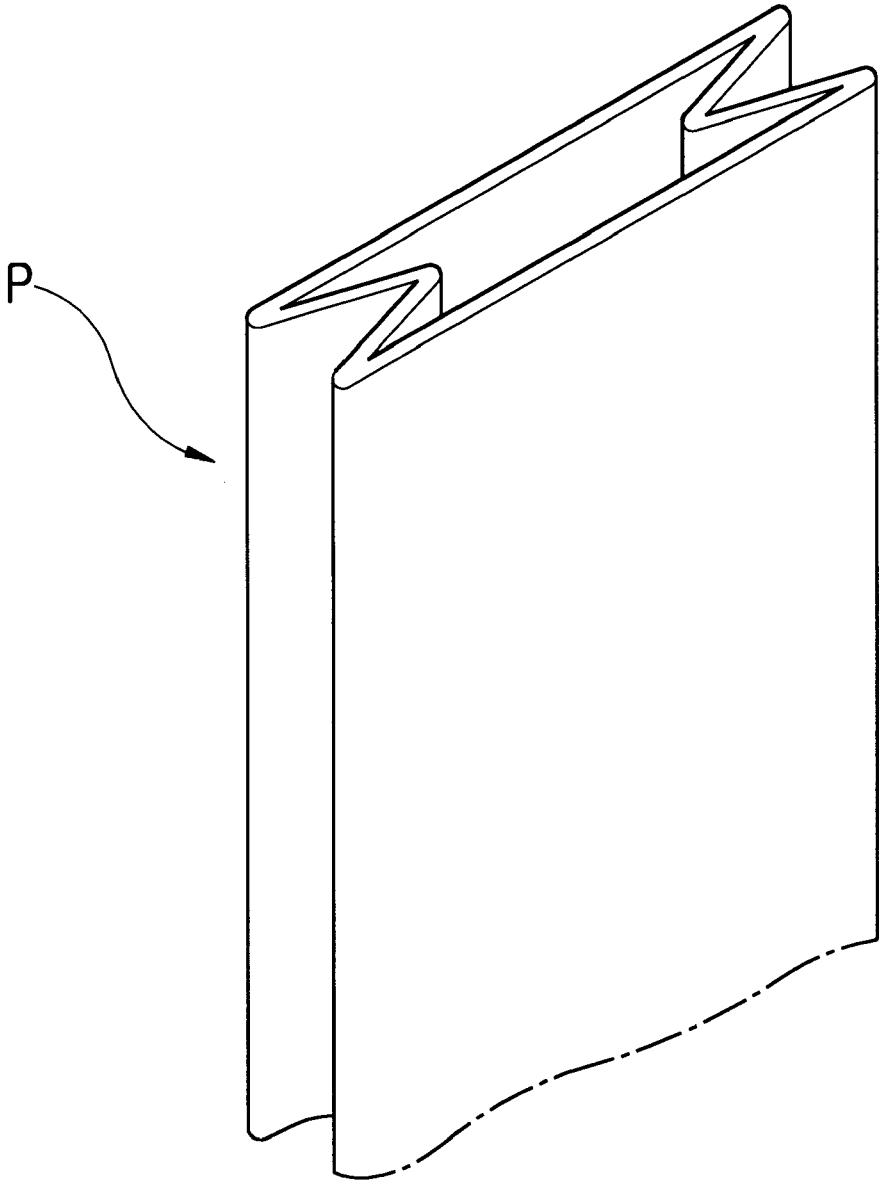
FIG. 8 is a perspective view of tube film to be inserted to a cylindrical bag according to the present invention.

On the other hand, air is introduced to the cylindrical bag 100 in which the tube film (P) is inserted by passing and surrounding the film receiving box 4 at the next processing station, and the tube film (P) which had been folded as in FIG. 8 is unfolded in circular form and closely contacted to internal surface of the cylindrical bag 100; and then the film is thermally adhered at radio frequency thermal adhering process.

In accordance with the present invention as described above, in a state that the cylindrical bag woven by a weaving machine is previously manufactured so as to have lengths of 1500–2000 m by each size whereby wound on rollers, etc., upon manufacturing waterproof bag, the tube film to be matched to the respective sizes is extruded at high speeds and at the same time stacked in the zigzag manner within the interior of the box of the elongate rectangular form. In a state that said box is made to be wholly contained within interior of the cylindrical bag, the cylindrical bag and tube film are joined. Therefore, there is the effect that an inserting operation of the tube film into the cylindrical bag becomes very easy and speedy for the production of waterproof bag of various size become possible and thereby productivity is improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system for supplying tube film for waterproof bag production comprising:

a film unwinding means which is provided with guide rollers for guiding a tube film pulled from a bobbin and tension controlling rollers, which are elastically supported by springs, and controlling a pulling tension;

a base in which first and second lifting chambers are formed at a bottom portion, and conveying racks are provided at a top portion;

a basic carriage which is connected to the conveying rack of the base which reciprocates at the top portion of the base a response to a bi-directional drive motor;

upper and lower pulling rollers provided in pairs, respectively, at top and bottom portions of the basic carriage, and rotating to pull the tube film from said film unwinding means by a uni-directional drive motor;

first and second lifters which are disposed in each of said first and second lifting chambers, selectively moving up and down by actuation of each lifting cylinder;

a film receiving box which is selectively placed on said first and second lifters, and which receives the tube film pulled from said reciprocally operating basic carriage in a zigzag stacked state on the first lifter, and which moves to the second lifting chamber according to operation of said first and second lifters when the stacking and folding is finished;

a horizontally conveying cylinder which horizontally pushes the film receiving box on said first lifter at a time when said first and second lifters are down, in order to move the film receiving box stacked with said tube film in a folded zigzag configuration to said second lifter position, and thereby loading the box onto said second lifter;

a pair of guide rollers which are respectively provided at both sides of the film receiving box so as to support rotating rollers which are protruded and attached to both sides of the film receiving box placed on each of the lifters at positions where said first and second lifters are lifted up; and forward and backward driving cylinders for forwardly conveying said guide rollers to downward positions of rotating rollers of said film receiving box at a time when the film receiving box is at the lifted position, and backwardly driving said guide rollers so as to release the supporting state at a time when the film receiving box is down.

2. The system of claim 1, further including pressing circular rollers for pressing the tube film to prevent looseness of the stacked tube film when said basic carriage is reciprocally driven and stacking the tube film into said film receiving box in a folded zigzag configuration.

* * * * *